US005725164A

United States Patent [19]

Binner

[11] Patent Number: 5,725,164

[45] Date of Patent: Mar. 10, 1998

[54] METHOD OF WINDING A RIBBON FREE YARN PACKAGE

[75] Inventor: Tobias Binner, Radevormwald, Germany

[73] Assignee: Barmag AG, Ramscheid, Germany

[21] Appl. No.: 657,040

[22] Filed: May 29, 1996

[30] Foreign Application Priority Data

May 29, 1995 [DE] Germany ..... 195 19 573.6

[51] Int. Cl.[6] ..... B65H 54/38

[52] U.S. Cl. ..... 242/18.1

[58] Field of Search ..... 242/18.1, 43 R

[56] References Cited

U.S. PATENT DOCUMENTS

| | | | |
|---|---|---|---|
| 4,049,211 | 9/1977 | Specha | 242/18.1 X |
| 4,296,889 | 10/1981 | Martens | 242/18.1 |
| 4,325,517 | 4/1982 | Schippers et al. | 242/18.1 |
| 4,504,024 | 3/1985 | Gerhartz | 242/18.1 |
| 4,667,889 | 5/1987 | Gerhartz | 242/18.1 |
| 4,771,961 | 9/1988 | Sugioka | 242/18.1 |
| 4,789,112 | 12/1988 | Schippers et al. | 242/178 |

FOREIGN PATENT DOCUMENTS 2 165 045 7/1973 Germany .

*Primary Examiner*—Michael Mansen

*Attorney, Agent, or Firm*—Bell Seltzer Intellectual Property Law Group of Alston & Bird LLP

[57] ABSTRACT

A method for winding a yarn in a random wind at a rated traversing frequency in a predetermined course, and so as to produce a ribbon free randomly wound package. For avoiding ribbon formations, a critical range characteristic of a ribbon is traversed at a changed traversing frequency. In particular, the traversing frequency is slowed down constantly or in steps upon entry into the critical range, and it is increased suddenly in the further course within the critical range to a value above the rated traversing frequency. After increasing the traversing frequency, same is slowed down constantly or in steps, so that upon exit from the critical range the traversing frequency assumes the value of the rated traversing frequency.

16 Claims, 3 Drawing Sheets

METHOD OF WINDING A RIBBON FREE YARN PACKAGE

BACKGROUND OF THE INVENTION

The invention relates to a method of winding a yarn in random wind.

In the winding of yarns to cross-wound packages, there arises the problem of breaking a so-called "ribbon". A ribbon forms as the diameter of a package increases, in particular when one or more package revolutions occur per double stroke of the yarn traversing mechanism, i.e., when the ratio of package speed to frequency of double strokes of the yarn traversing mechanism is equal to 1, an integral multiple, or a fraction or ratio of integers. In this connection, a double stroke is defined as a complete reciprocal movement of the traversing yarn guide. The winding ratio of package speed to frequency of double strokes is generally designated by the letter K. Thus, ribbons occur, when K=1, 2, 3 . . . m, or when it is a fraction of whole numbers.

Ribbons, which are also called ribbon winds, lead to certain disturbances when the packages are unwound. Further, during the winding, ribbons lead to oscillations of the takeup machine and, thus, to an unsteady contact of the drive roll with the package. They also lead to a slip between drive roll and package, and finally also to damage to the package. It is therefore necessary to avoid ribbons, in particular in the case of flat yarns, such as, for example synthetic filament yarns. It results from the definition of the ratio K that this may occur either by changing the package speed or by a change of the double stroke frequency.

Furthermore, it should be noted that the circumferential speed of the package, in particular in the field of spinning and processing synthetic fibers, is maintained constant, so that the ribbon breaking occurs in general by a change of the double stroke frequency of the traversing yarn guide. In this connection, it should be noted that the present invention relates in the general case both to a change of the package speed and to a change of the double stroke frequency of the traversing yarn guide, should this be technologically necessary and feasible.

It is known from DE-OS 2165045 to control the yarn traversing operation such that the aforesaid ratio is not a whole number. This is realized in that shortly before reaching an integral ratio K, the yarn traversing speed is changed. While this method is effective, it is however difficult to realize technologically and economically, in particular since a textile machine that is used for winding has practically always a plurality of takeup units which exhibit different package diameters at any point in time. This means that basically a change of the yarn traversing speed is possible only in individually driven takeup units, and that in this instance each takeup unit would have to be associated with a diameter scanner or a programmer and a controller for changing the traversing speed. This, however, would require a relative great expenditure in apparatus and engineering.

Further known is a so-called "wobbling" for breaking a ribbon, wherein the traversing speeds are periodically varied between a minimum speed and a maximum speed, which define the wobble range, under a predetermined law, for example, sine, saw tooth, etc. Normally, a wobble stroke amounts from +/− 1% to +/− 20% of the average traversing speed. In the now commonly used takeup machines, the double stroke frequency or double stroke rate is up to several 1000 per minute. However, this known wobbling method is not suitable to effectively prevent the formation of ribbons. For example, it was observed that without ribbon breaking, a ribbon of the fourth order formed for the duration of one minute, whereas the same ribbon with wobbling appeared for a duration of eight minutes, without substantially lessening the symptoms of the ribbon by the wobbling. For purposes of totally eliminating the wobbling, if possible, it was proposed in DE-OS 28 55 616 and corresponding U.S. Pat. No. 4,296,889 to perform a ribbon breaking by permanently changing the traversing speed in an aperiodic manner. Thus, the traverse speed is changed even when the random wind would produce no ribbon formation at all.

Known from "Barmag Information Service 31", 9/1991, page 38, is a possibility of producing a ribbonfree package that consists of applying a so-called "step precision wind." In this wind, a series of precision winds are produced during a winding cycle with winding ratios in accordance with a predetermined table of established K factors. Thus, the package is wound totally free of ribbons without substantially affecting the constant angle of yarn deposit that exists in a random wind. While a step precision wind (SPW) ensures that the advantages of the random and precision winds are combined with one another, an optimal selection of the combination between the random and the precision wind in the meaning of minimum expenditure with maximum success is however absent.

Known from EP 0 093 258 A2 and corresponding U.S. Pat. No. 4,504,024 is likewise a method of ribbon breaking when winding a yarn in random wind. Based on the known relation for the K value, which is also named winding factor, in the known method the traversing speed is changed such as to result in a sudden change of the winding factor. In this process, such a change of the winding factor is realized as to ensure that likewise the changed winding factor is outside of a predetermined safety range. The jump height of the winding factor is to be preferably equal to twice the safety distance. Safety distance and minimum distance are defined preferably as a certain fraction p of the ribbon value being avoided, or of the winding factor, which results as the quotient from the momentary measurement of the spindle speed and the traversing speed or the double stroke frequency. The problem now is that the fraction p must be determined by tests or from the textile data of the takeup operation. Thus, the safety distance and the minimum distance are to be determined preferably by empirical results. The essential disadvantage of such a method lies, among other things, also in that in the region of a ribbon, the yarn is wound at a speed substantially deviating from the rated traversing speed. As a result, a considerable change occurs in the angle of yarn deposit and, thus, the actual random wind. Furthermore, the safety distances from the ribbon are often selected unnecessarily large for lack of empirical results, so that corresponding great deviations occur between the rated traversing speed and the changed traversing speed.

It is therefore the object of the present invention to provide a method of attaining a ribbon breaking when winding a yarn in random wind on a spindle, wherein the characteristics of the random wind are maintained with the least possible deviation. Furthermore, it is an object of the invention to predetermine a ribbon formation that is to be expected on the basis of parameters that result from determining suitable winding parameters from the current process, to establish a criterion of the danger of such a ribbon formation, and to produce a ribbon breaking only upon occurrence of dangerous ribbon formations.

SUMMARY OF THE INVENTION

The above and other objects and advantages of the present invention are achieved by the provision of a method and apparatus which comprises the steps of winding the advancing yarn onto the rotating package while the yarn is traversed at a rated traversing frequency, determining a critical winding ratio range at which undesirable pattern formations would normally occur.

In accordance with the invention, the danger zone of a ribbon is traversed such that upon entry into the critical range, the traversing frequency is slowed down constantly or in steps, so that the traversing frequency is initially changed to a value below the rated traversing frequency. The rated traversing frequency is, in this instance, the traversing frequency that is predetermined for producing a random wind. It is constant or changed slightly during the winding cycle, but without a fixed ratio to the speed of the winding spindle.

Within the critical range, the traversing frequency undergoes a sudden increase, so as to suddenly pass through the ribbon (critical winding ratio). Subsequently, the traversing frequency is again slowed down constantly or in steps, until the traversing frequency assumes again the value of the rated traversing frequency. This allows to accomplish that during the winding of the yarn the angle of deposit undergoes only slight changes, which results again in little changes in the yarn tension.

To limit the jump height within the danger zone, same is defined in a preferred embodiment of the invention by the limit values of the traverse, which correspond to the constant winding ratios that result upon entering (KE) the danger zone and upon leaving (KA) the danger zone at the rated traversing frequency. Thus, the winding ratios resulting from the change in the traversing frequency are always smaller, before the jump, than the winding ratio KE at the entry side and, after the jump, they are always greater than the winding ratio KA at the exit side of the danger zone.

To deviate as little as possible from the advantageous random wind, a further embodiment provides that upon entry into the danger zone the traversing frequency is slowed down such that a constant winding ratio KE is maintained, i.e., a precision wind is realized. Within the danger zone, the sudden increase of the traversing frequency occurs to such an extent that the new value of the traverse results again in a constant winding ratio KA, as exists upon exit from the danger zone at the rated traversing frequency. Thus, upon a change of the traversing frequency, the winding ratio before the jump is equal to KE and after the jump equal to KA.

Since the danger zone, the determination of which is described further below, is symmetrical to the ribbon, a particularly advantageous variant of realization exists, when the sudden increase of the traversing speed occurs in the center of the danger zone. This allows to accomplish that the respective distance between the changed traversing frequencies and the rated traversing frequency is substantially the same. In addition, the critical range of the ribbon is traversed at maximum acceleration.

A further development of the method in accordance with the invention provides a solution to the case that adjacent ribbons have each critical zones which overlap. In this instance, it is necessary to consider as critical in particular the regions between the ribbons, since a noncritical winding ratio is absent. In this event, the traversing frequency is "wobbled" in steps, in that it is changed in the overlapping area between two values with a constant winding ratio. Selected as winding ratios are, in this instance, a winding ratio KA1 upon exit from the first critical zone at the rated traversing frequency and a winding ratio KE2 upon entry into the second critical zone at the rated traversing frequency.

In accordance with the invention, the critical zone of the imminent ribbon is determined only when a critical parameter calculated from the winding parameters during the current process exceeds a predetermined acceptable control value. To this end, the takeup parameters are first determined during the current takeup process, from which the actual K values are calculated thereafter. The course of the K value over the particular package diameter is in principle hyperbolic. Subsequently, the next ribbons are calculated from the actual K values taking into account ribbons up to a certain order (for example, the fifth order).

In a next step, the danger of each ribbon is estimated, in that a critical parameter is calculated and compared with a predetermined control value. On the basis of the critical parameter, a critical zone in the form of a critical diameter interval is determined. Within this critical diameter interval, the random wind is changed to, for example, the precision wind, and the traversing frequency is suddenly changed essentially in the center of the critical diameter interval.

The sudden change of the traversing frequency corresponds, in this process, preferably to substantially twice the amount with reversed sign of its deviation from the traversing frequency corresponding to this diameter during the random wind. Therefore, a jump of the traversing frequency occurs Substantially in the center of the critical diameter interval, so that the deposit angles of the precision wind in the critical diameter interval exhibit a minimal deviation from the deposit angle of the random wind.

As is known, the traversing speed influences the yarn speed/yarn tension.

A jump of the traversing frequency in the center of the critical diameter interval is of advantage, since it allows to keep the deviation from the random wind at a minimum. Thus, this method allows to accomplish that no unsatisfactory or unfavorable K value is maintained. Any other kind of jump, as well as a jump of the traversing frequency outside of the center of the critical diameter interval are possible.

In preferred embodiment of the invention, the danger of imminent ribbons is determined by defining a bandwidth about the K value, by subsequently calculating the diameter of the spindle associated with this bandwidth, as well as computing thereafter the time, during which this band width is traversed. Finally therefrom, the number of yarn layers is calculated that are deposited on top of one another, which is considered as a critical parameter. If the calculated number of the layers exceeds the predetermined control value, the yarn will be classified as critical. Then, the critical zone is determined, so as to be able to make changes in the traversing frequency upon entry into the critical zone.

Preferably, the critical zone is determined by preparing in control-internal manner a critical diameter diagram, drawing a decay curve about each critical parameter corresponding to a ribbon, and by determining a control value in the form of a straight line, above which the ranges with a danger exceeding this control value may be determined. To determine the critical diameter diagram, the associated package diameter DS is initially computed from the K value of the ribbon. Thereafter, the critical parameters—in this instance the yarn layers—are plotted in point DS. By drawing a decay curve, the initial package diameter DE and the final package diameter DA of the critical zones are obtained together with the control value. As the diameters DE and DA are determined, the winding ratios KE and KA are defined likewise. Assumed as decay curve is preferably a trigonometric function. Likewise possible are other decay functions, such as, for example, the Gauss function or certain exponential functions.

In an especially preferred embodiment of the invention the danger of the imminent ribbons is determined from the spacing between adjacent wound yarns. The yarn spacing decreases continuously toward a ribbon center, where it is approximately zero. For it, a control value may be determined which ensures that no ribbon-typical detrimental effect occur. The yarn spacing is continuously computed from the actual K value, the angle of deposit, and the traverse stroke. If it falls below a predetermined control value, i.e., adjacent yarns are too close together, the critical zone is determined. In so doing, the K value considered in the calculation of the yarn spacing represents already the K value KE at the entry to the critical range. With that, also the package diameter DE is established. Since the next critical K value of the ribbon is likewise known, the associated package diameter DS can be calculated therefrom. Since the yarn spacing decreases symmetrically toward the ribbon, and increases after passing through the ribbon, the spacing in the critical range preceding the ribbon is equal to the spacing following the ribbon. As a result of this fact, the package diameter upon leaving the critical range can be computed from the package diameter at the entry and the package diameter at the ribbon DS. Once the package diameter DA at the exit is determined, the winding ratio KA at the exit is likewise on hand, so that the traversing frequency can be changed within the corresponding limits.

Determined as winding parameters from the current process are spindle speed, traversing frequency, package diameter, and quadratic diameter increase, as well as the spindle speed and the spindle diameter, at which these ribbons occur.

In accordance with the invention, when a limit value of the danger that is to be predetermined is exceeded, the traversing frequency of the spindle is readjusted, so that the K value for realizing a precision wind remains constant at least in certain sections within the critical diameter interval.

Accordingly, in a preferred embodiment of the method, the traversing frequency is increased at a maximum acceleration, upon reaching a diameter of the package, which corresponds to half the difference between the points of entry and exit of the critical range. The half difference corresponds to the center of the critical diameter range, the limit values of the critical diameter interval being determined by exceeding the critical parameter above the control value. In this instance, the new traversing frequency is selected such that the same K value is attained that would be reached, without influencing the traversing, in a random wind at the point of exit from the critical range.

After this jump of the traversing frequency, same is preferably readjusted, subsequent to the spindle frequency, until an actual angle of deposit is equal to an angle that was predetermined as a desired value. A least possible change in the angle of deposit should be attempted, for example, in a range from +1° to −1°, which is more advantageous than, for example, +2° or −2°.

Moreover, it is also possible to realize, instead of the precision wind, no constant course of the K-value, but a course deviating from the original random wind.

BRIEF DESCRIPTION OF THE DRAWINGS

Further advantages and possible applications of the invention are described in more detail below, with reference to the description of an embodiment and the Figures. In the drawing.

DETAILED DESCRIPTION OF THE PREFERRED EMBODIMENTS

Figure 1:
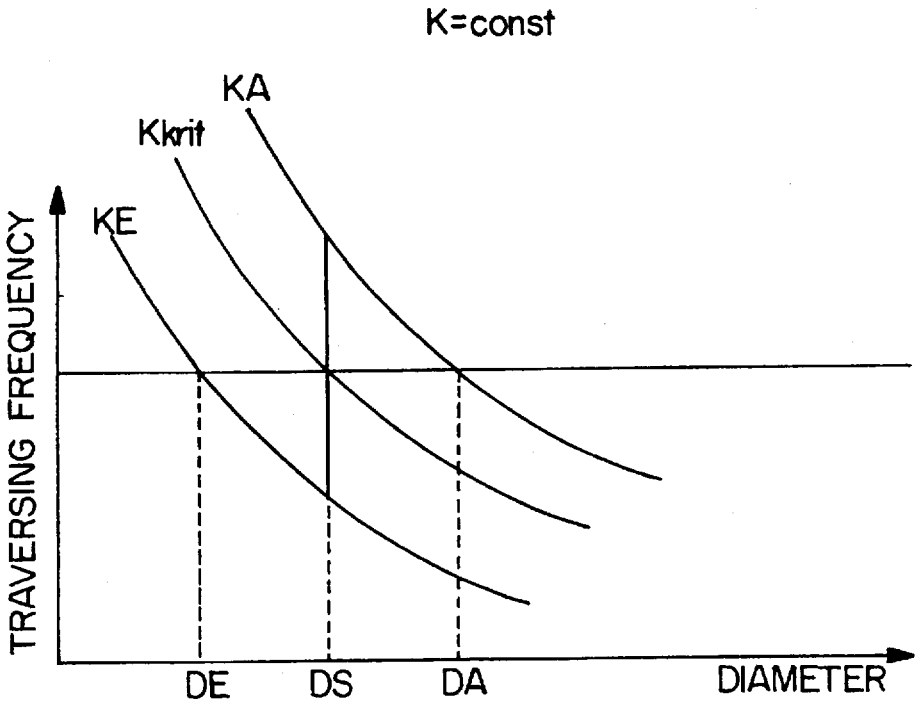
FIG. 1 is a diagram showing the course of the traversing frequency above the package diameter with a constant variation in the critical range.
Figure 6:
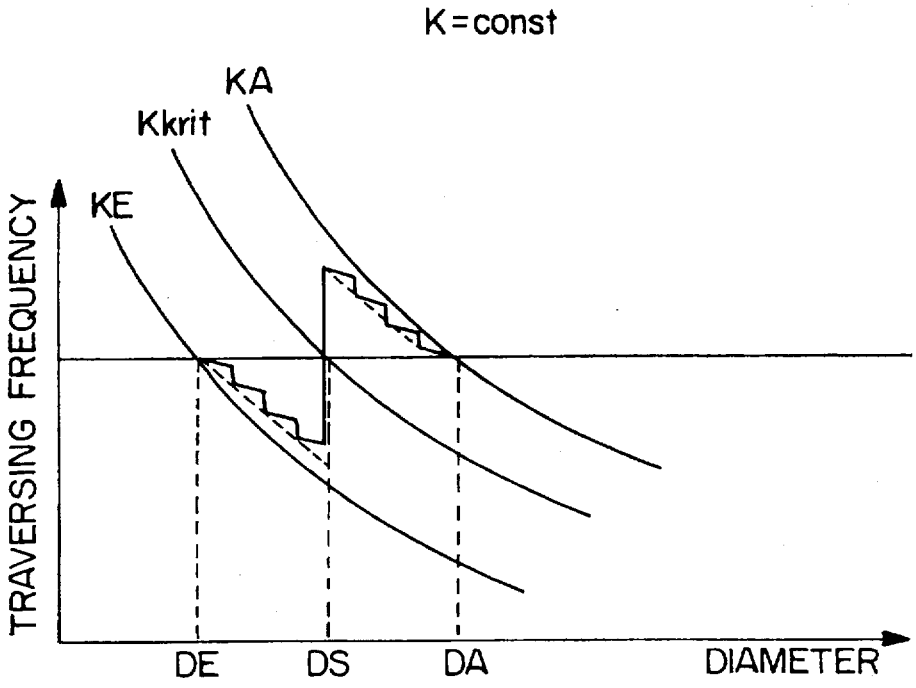
FIG. 6 is a diagram of the course of the traversing frequency above the package diameter with a stepwise variation in the critical range.

Shown in the diagrams of FIGS. 1 and 6 are the variations of the traversing frequency made while winding a yarn in a random wind and while traversing a ribbon. In the random wind, the traversing frequency is substantially constant and independent of the speed of a winding spindle. This results in a constant angle of yarn deposit. However, since the spindle speed decreases as the package diameter increases, the winding ratio, i.e., the ratio of spindle speed to traversing frequency decreases constantly, namely hyperbolically, as the package diameter increases. In the diagram, the traversing frequency is plotted above the package diameter. In an optimal random wind, the takeup process would follow a predetermined course of the rated traversing frequency. For schematic illustration thereof, a course corresponding to a straight line parallel to the abscissa was selected. However, with such a course a critical winding ratio is bound to be met during a winding cycle. In the diagram, the critical winding ratio is indicated at $K_{krit}$ and takes the course of a hyperbola. The intersection of the critical winding ratio and the rated traversing frequency defines the package diameter DS at a ribbon. When determining a critical range, as will be described further below, an entrance package diameter DE and an exit package diameter DA are defined. Therefrom, the winding ratios are obtained at the entrance to the critical range at KE and at the exit from the critical range at KA. The curves of winding ratios KE and KA represent limit values of the traversing frequency, within which the traversing frequency is changed.

In the diagram of FIG. 6, the traversing frequency is slowed down stepwise until the critical diameter DS is reached, the thereby obtained winding ratios being always smaller than the winding ratio KE at the entrance to the critical range. In the vicinity of the ribbon diameter, the traversing speed is suddenly increased to a value above the rated traversing frequency, the thereby adjusting winding ratio being greater than the winding ratio KA at the exit from the critical range. Subsequently, the traversing frequency is slowed down in steps until reaching the rated traversing frequency at the exit from the critical range.

In a preferred embodiment, as shown in the diagram of FIG. 1, the traversing frequency is continuously slowed down upon entering the critical range with a delay which permits the entrance winding ratio KE to remain constant. Thus, a precision wind is produced for the time being. The traversing frequency is slowed down until reaching the ribbon diameter. In the ribbon diameter, a sudden increase occurs to the winding ratio KA. Thereafter, the traversing frequency is again decreased such that the winding ratio KA remains constant. Upon leaving the critical range at the package diameter DA, the rated traversing frequency is reached. This method is characterized especially in that the deviations from the rated traversing frequency turn out to be, as small as possible and symmetrical when passing through a ribbon.

For determining the critical range, the critical parameters of the next ribbons are first calculated and compared with a control value. In the method, a difference is made basically between two possibilities of computing the critical parameters.

To begin with, in a main step 1 of a variant of the method described below by way of example, the following parameters are determined from the current process:

The spindle frequency=$f_{spi}$;

the double stroke rate of the traversing mechanism (traversing frequency)=DHZ;

the package diameter D; and the quadratic diameter increase=$QZ=(D2)^2-(D1)^2/(T2-T1)$. Computed from these actual data are:

The actual K value;

the next imminent ribbons=$K_{krit}$;

the order of the imminent ribbons=Ord the spindle speeds, at which these ribbons will occur=$f_{Spikrit}$; and the diameters, at which these ribbons will occur=$D_{krit}$.

In main step 2 of the method in accordance with the invention, these data will be used for evaluating the imminent ribbons individually by their critical extent. This evaluation occurs as follows:

A band is defined about the K value for the imminent ribbon, for example:

2%: $K1_{krit}=0.98\%\cdot K_{krit}$, $K2_{krit}=1.02\cdot K_{krit}$;

Subsequently the associated diameters are calculated for this band: $D1_{krit}=D(K1_{krit})$; $D2_{krit}=D(K2_{krit})$.

Thereafter, the time is calculated, during which this band is traversed:

$T_{krit}=[(D2_{krit})^2-(D1_{krit})^2]/QZ$;

Further computed are the number of yarn layers that are deposited on top of each other in this band.

$N=T_{krit}\cdot f_{Spikrit}/K_{krit}/Ord$

N will then be the critical parameter of a ribbon.

Figures 2, 3, 4:
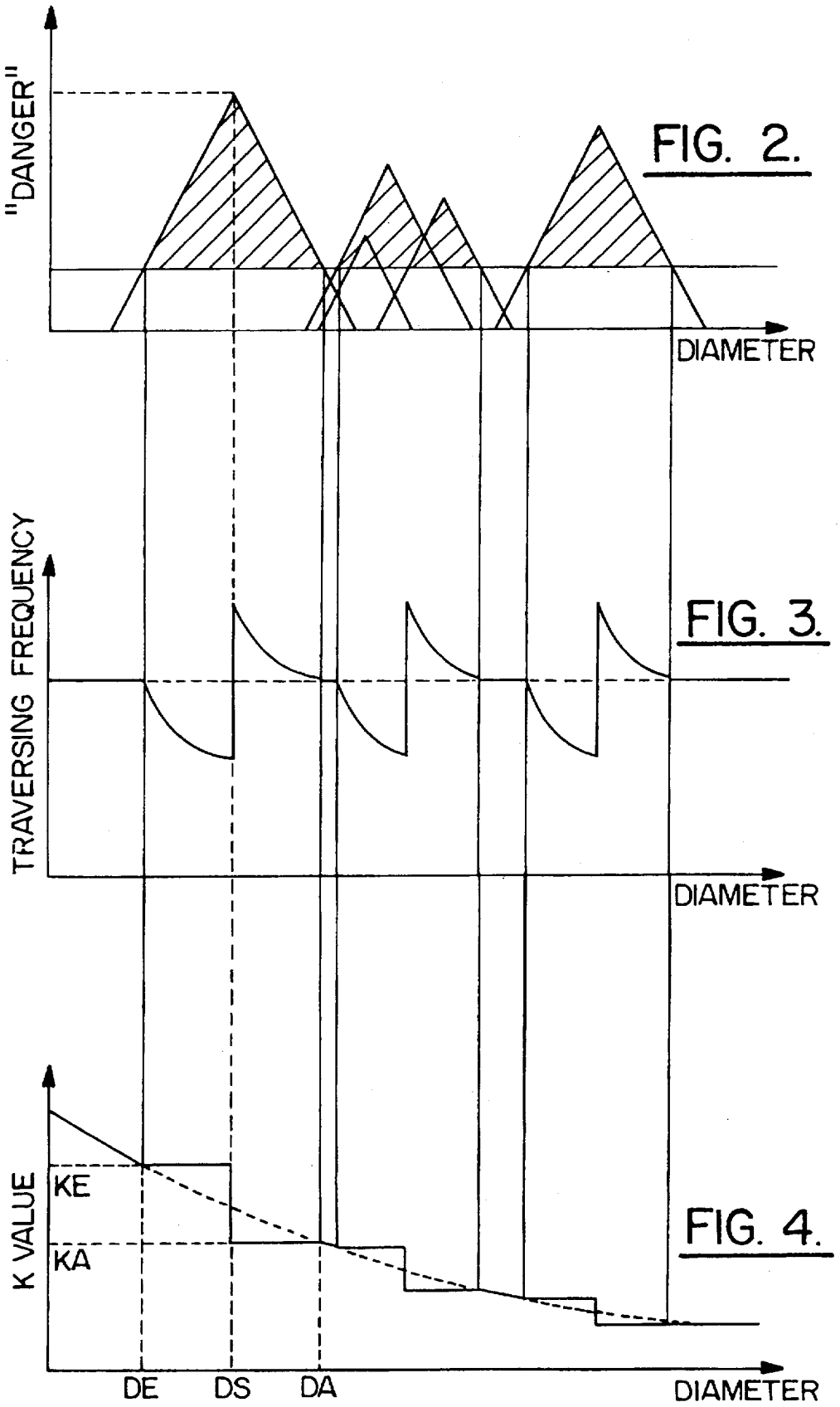
FIG. 2 is a diagram of the critical ranges above the diameter with a triangular decay curve of the ribbons.
FIG. 3 is a diagram showing the course of the traversing frequency above the package diameter.
FIG. 4 is a diagram showing the K value above the package diameter.

In a main step 3, these data are used to prepare a diagram in control-internal manner. In this diagram the danger or critical ranges is or are plotted above the diameter. An example for such a diagram is shown in FIG. 2. This diagram forms the basis for a deliberate intervention in the control of the textile machine, so as to deliberately generate a ribbon breaking for avoiding a ribbon formation. Each apex of the hatched triangles represents a diameter-related location of a more or less critical ribbon. The "more or less" is identified by the magnitude of the critical parameter above the abscissa.

The decay curve shown as a triangle characterizes hypothetically the decline of the danger of the ribbon related to the actual, diameter-related location of occurrence of the ribbon.

In FIG. 2, the horizontally drawn line characterizes the control value, from which (when viewed in the direction of the ordinate) a ribbon may be considered as critical in accordance with the above-characterized "more or less". The kind of decay curve, which may be any kind of physically useful curve, determines, in combination with the control value, the magnitude of the critical diameter interval DE to DA. This critical diameter interval is defined by the intersection of the decay curve and the straight-line of the control value. The object of determining these dangerous, critical diameter intervals, i.e., of the quasi weighted critical ranges, is to proceed with a controlled influencing of the traversing frequency that is adapted in accordance with the weighing of the critical range. Such an influencing is performed only and "well measured", when same is required as a result of the critical curve or the danger diagram. This critical-diameter diagram is set up or determined in control-internal manner in this main step 3.

If two or more critical peaks (ribbons) are present in a critical diameter interval, such as shown, for example, in FIG. 2, it will also be possible to subdivide the critical diameter interval into a number corresponding to the number of peaks, and to thereafter realize in each partial interval a corresponding jump of the traversing frequency, preferably in the center of the partial interval.

In a main step 4 of the method in accordance with the invention, the deliberate or "well measured" change of the traversing frequency, as addressed already above, is made as a function of the diameter of the spindle, the influencing of the traversing frequency starting gradually effective the point in time, when the danger exceeds a certain control value. Effective this point, the traversing frequency of the spindle frequency is readjusted such that the K value remains constant. Thus, a precision wind is realized in the region of the constant K value. The longer the K value remains constant, or the longer the precision wind is maintained, when related to the diameter increase of the package or spindle, the more the actual K value moves away from the curve corresponding to a random wind, which is shown in dashed lines in FIG. 4.

To ensure that the K value deviates, on the average of a critical diameter interval as little as possible from a random wind, the traversing frequency is increased at the maximum acceleration of the traversing mechanism, when the package diameter has approximately reached the ribbon diameter DS, which corresponds to about half the difference between the points DE and DA of the critical range. The center of the critical diameter interval corresponds in this instance to the point, in which the ribbon is expected. The deceleration of the traversing frequency that is realized for the time being, is compensated, in that at the point of the jump, twice the deviation of the traversing frequency from the traversing frequency corresponding to this diameter in a random wind is placed by reversing the sign, i.e., the traversing frequency moves into the-positive region (acceleration of the traversing frequency). The new traversing frequency is selected such that the same K value is obtained, which would have been reached in an uninfluenced traversing operation (i.e., a traversing in a random wind) at the point of exit from the critical range.

For each critical range, i.e., for each range of the critical diameter, the qualitative course of the traversing frequency in FIG. 3 is associated to the respective critical ranges. Ranges of constant traversing frequency Correspond in this instance to ranges, in which the traversing frequency is not changed. These ranges correspond to the ranges in FIG. 2, which represent sections as the critical threshold, i.e. horizontal sections between the dangerous critical diameter ranges. After this jump, the traversing frequency is again adjusted to the spindle frequency, so that the K value remains constant, and that, as shown in FIG. 4, the K value of the precision wind approximates gradually the K value in the random wind, as the diameter increases. This point is reached, when the K value of the random wind intersects the constant K value of the precision wind in the point, which represents the end of the first critical range shown in FIG. 2. In this condition, the actual angle of deposit is equal to the angle that has been predetermined as desired value.

In a second variant of determining the danger of a ribbon, a critical parameter is calculated on the basis of the yarn distance and a critical range is defined. In so doing, the following, in part analogous steps of the first variant of the method are performed:

In a first main step, the following parameters are again determined from the current process:

The spindle frequency=fspi the double stroke rate of the traversing (traversing frequency)=DHZ;

the package diameter D; and the traverse stroke H. Computed from these actual data are:

the actual K value;

the angle of deposit $\alpha$ at constant yarn speed; and the nearest ribbon K value $K_{krit}$ of any desired order.

In a second main step, the yarn distance defined as critical parameter between two adjacent yarns on the package is determined and evaluated from the actual K value:

Calculation of the yarn distance $E=2H\cdot\cos\alpha/K/N$; and

Comparison of the calculated yarn distance E with a control value.

In a third main step, the determined data are used to determine the critical range of the ribbon:

Calculation of the entrance package diameter $DE=2H/\pi/\sin\alpha/KE$;

Calculation of the package diameter at the ribbon $DS=DE\cdot KE/K_{krit}$;

Calculation of the exit package diameter $DA=DE+2(DS-DE)$; and

Calculation of the winding ratio at the exit $KA=DA\cdot\pi\cdot\sin\alpha/2H$.

Thus, the characteristic values shown in the diagram of FIG. 1 are defined for the critical range, so that the control of the textile machine can perform the change in the traversing frequency accordingly.

For the entrance into the critical range, the yarn distance E is selected. This yarn distance decreases constantly as a ribbon is approached. The control value of the yarn distance, which is still outside the ribbon- critical winding range, is dependent on the width of the yarn deposit and, thus, on the denier of the yarn. With a yarn having a denier from 30 to 150 dtex, the control value of the yarn distance is about 3.5 mm.

In this variant of the method, the constantly changing K value is determined continuously from the momentary package diameter. When determining the yarn distance, the deviation or the distance of the momentary K value from the K value of the ribbon is taken into account by a displacement factor N. Should it be found that the calculated yarn distance falls below the acceptable control value, the momentary K value is considered as the K value KE at the entry. Thus, the start of the critical range is defined. Since the distribution of the yarn distance occurs on the package symmetrically to the ribbon, the critical range can be determined alone from the package diameter interval.

In both variants of the method, the predetermined control values are based to an essential extent on experience and test results.

In practice, it occurs frequently that two adjacent ribbons are so close together that their critical ranges overlap. In this event, as shown in FIG. 3, it is possible to classify the overlapping critical ranges as one critical range with one entrance and one exit. In this instance, the traverse frequency is increased suddenly only one time in the entire interval.

Figure 5:
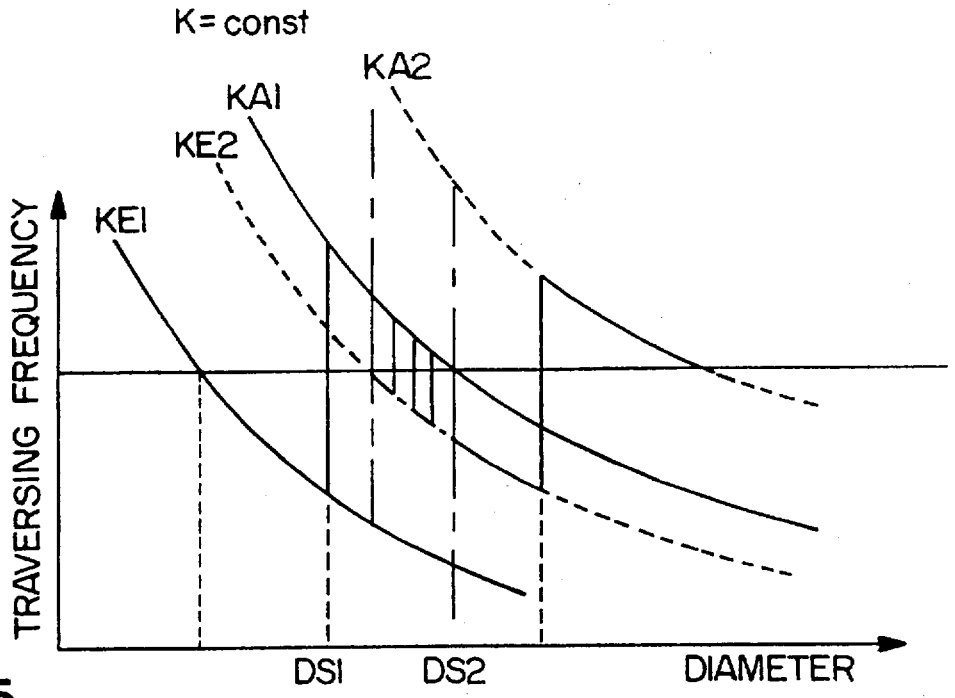
FIG. 5 is a diagram showing the course of the traversing frequency above the package diameter with overlapping critical ranges.

As shown in the diagram of FIG. 5, the two adjacent critical ranges around a first critcal diameter DS1 and a second critical diameter DS2 are traversed each with one acceleration phase of the traversing frequency. Since in this instance, there are only winding ratios between the ribbons, which are conditionally suitable, it is advantageous to periodically change the traversing frequency between two constant winding ratios. As a result of this kind of wobbling, the range between the ribbons is traversed advantageously. The winding ratios are defined each by the winding ratio KA1 at the exit of the first critical range and by the winding ratio KE2 at the entrance to the second critical range. Advantageously, the wobbling occurs only in the overlap area of the two critical ranges.

Significant advantages of the method of the present invention lie in an optimal package build with respect to avoiding a formation of ribbons, in an absence of adjustment efforts, an automatic adaptation when changing the product, and in the fact that the takeup process is optimized as a whole, since it is necessary to operate with a precision wind only in the range of the critical diameter.

That which is claimed is:

1. A method of winding an advancing yarn onto a rotating package, and comprising the steps of winding the advancing yarn onto the rotating package while the yarn is traversed at a rated traversing frequency, determining a critical winding ratio range at which undesirable pattern formations would normally occur, monitoring the winding ratio during the winding step, and upon entry of the monitored winding ratio into the critical winding ratio range, decelerating the traversing frequency, then rapidly increasing the traversing frequency to a value above the rated traversing frequency, and then decelerating the traversing frequency, so that upon exiting from the critical winding ratio range, the traversing frequency assumes the value of the rated traversing frequency.

2. The method as defined in claim 1, wherein during the first mentioned decelerating step the winding ratio is smaller than the winding ratio at the time of entry into the critical range, and during the second mentioned decelerating step the winding ratio is greater than the winding ratio at the time of exit from the critical range.

3. The method as defined in claim 1, wherein during the first mentioned decelerating step the winding ratio is equal to the winding ratio at the time of entry into the critical range, and during the second mentioned decelerating step the winding ratio is equal to the winding ratio at the time of exit from the critical range.

4. The method as in claim 1 wherein the step of rapidly increasing the traversing frequency occurs approximately at the midpoint of the critical range.

5. The method as defined in claim 1 comprising the further step of determining a second critical winding ratio range which overlaps the first mentioned critical winding ratio range, and wherein the traversing frequency is changed in the overlap range such that the winding ratio jumps periodically between the winding ratio (KA1) at the exit from the first mentioned critical winding ratio range and the winding ratio (KE2) at the entrance to the second critical winding ratio range.

6. The method as defined in claim 1 comprising the further step of determining a second critical winding ratio range which overlaps the first mentioned critical winding ratio range, and wherein the step of rapidly increasing the traversing frequency occurs approximately at the midpoint of the entire range which is composed of the first mentioned critical winding ratio range and the second critical winding ratio range and includes increasing the traversing frequency so as to assume the value of the rated frequency upon exit from the second critical winding ratio range.

7. The method as defined in claim 1 wherein the determining step includes determining when a critical parameter of a next ribbon as calculated from a winding parameter exceeds a predetermined acceptable control value.

8. The method as defined in claim 7, wherein the critical parameter of the next ribbon is determined from the number of layers of yarn deposited within a diameter bandwidth.

9. The method as defined in claim 8, wherein the yarn layers are determined by the following steps:

a) computing the K value of a ribbon and establishing a predetermined bandwidth around the K value;

b) computing package diameters associated to this bandwidth;

c) computing the time, in which this bandwidth is traversed; and d) computing the number of layers that are superposed in this bandwidth.

10. The method as defined in claim 9, wherein the bandwidth is predetermined as a percentage of the K value on each side of the K value.

11. The method as defined in claim 7 wherein, the step of determining when a critical parameter of a next ribbon exceeds a predetermined acceptable control value includes the steps of:

a) setting up in a control-internal manner a critical diameter diagram;

b) plotting a curve of decay about each point corresponding to a ribbon; and c) determining a critical diameter interval from intersections between the predetermined acceptable control value and the curve of decay.

12. The method as defined in claim 11, wherein that the curve of decay is a trigonometric function.

13. The method as defined in claim 7, wherein the critical parameter of the next ribbon is determined from the yarn distance between two adjacent wound yarns on the package.

14. The method as defined in claim 13, wherein the yarn distance is calculated continuously from a K value, the angle of deposit of the two adjacent wound yarns on the package, and the traverse stroke of the yarn.

15. The method as defined in claim 14, wherein the critical range is determined by the steps of:

a) computing an entrance diameter DE of the package associated to the K value;

b) computing a diameter DS of the package at the next ribbon; and c) computing an exit diameter of the package which equals DE+2(DS−DE).

16. In a method of winding a yarn into a core supported package in which the yarn is wound about the core at a substantially constant rate while the yarn is guided onto the core by a traversing yarn guide at a rated traversing frequency, and wherein the winding ratio, which is defined as the ratio of the rotational speed of the package to the double stroke rate of the yarn guide, gradually decreases as the package builds, the improvement therein comprising the steps of determining a plurality of critical winding ratio ranges at which undesirable pattern formations would normally occur, monitoring the winding ratio during the winding method, and upon entry of the monitored winding ratio into each critical winding ratio range, decelerating the traversing frequency, then rapidly increasing the traversing frequency to a value above the rated traversing frequency, and then decelerating the traversing frequency, so that upon exiting from the critical winding ratio range, the traversing frequency assumes the value of the rated traversing frequency.

* * * * *